US007766148B2

(12) United States Patent
Paget et al.

(10) Patent No.: US 7,766,148 B2
(45) Date of Patent: Aug. 3, 2010

(54) MONEY HANDLING UNIT PROVIDED WITH A REMOVABLE COIN RECEPTACLE

(75) Inventors: Jean-Marc Paget, Rochejean (FR); Damien Mandy, Fontain (FR); Jean Arifon, Saint Vit (FR)

(73) Assignee: Parkeon, Paris (FR)

( * ) Notice: Subject to any disclaimer, the term of this patent is extended or adjusted under 35 U.S.C. 154(b) by 213 days.

(21) Appl. No.: 11/665,000

(22) PCT Filed: Oct. 10, 2005

(86) PCT No.: PCT/FR2005/050834

§ 371 (c)(1),
(2), (4) Date: Jan. 29, 2008

(87) PCT Pub. No.: WO2006/040493

PCT Pub. Date: Apr. 20, 2006

(65) Prior Publication Data

US 2009/0014278 A1 Jan. 15, 2009

(30) Foreign Application Priority Data

Oct. 11, 2004 (FR) ..... 04 52331

(51) Int. Cl.
*G07F 9/10* (2006.01)
*E05G 1/024* (2006.01)
*E05G 1/026* (2006.01)

(52) U.S. Cl. ..... 194/344; 109/58

(58) Field of Classification Search ..... 193/344, 193/350, 353; 232/1 D, 1 F, 55; 52/124.1; 109/58, 73, 74, 66; 220/558, 255, 259.1, 220/825; 49/309, 319; 235/1 A, 24
See application file for complete search history.

(56) References Cited

U.S. PATENT DOCUMENTS

| | | | | |
|---|---|---|---|---|
| 3,292,849 A | | 12/1966 | Ewing | |
| 4,370,006 A | * | 1/1983 | Graef et al. | 312/215 |
| 5,009,365 A | | 4/1991 | Holtzer | |

FOREIGN PATENT DOCUMENTS

| | | |
|---|---|---|
| EP | 0201427 | 12/1986 |
| EP | 0320335 | 6/1989 |
| GB | 807880 | 1/1959 |
| GB | 2320604 | 6/1998 |
| JP | 08 287341 | 3/1997 |

* cited by examiner

*Primary Examiner*—John Q. Nguyen
*Assistant Examiner*—Mark Beauchaine
(74) *Attorney, Agent, or Firm*—Young & Thompson

(57) ABSTRACT

A money handling unit provided with a removable coin receptacle consisting of a fixed structure includes a housing (1) and a trap (2) for accessing into the box internal space movable between an open position and a closed position and a receptacle (3) insertable into the trap (2) and forming a reception structure, wherein the receptacle (3) has an orifice (4) for inserting coins and a closing shutter (5) movable between an open position in which the orifice (4) is accessible and a closing position in which the orifice (4) is closed. The inventive receptacle has actuating elements (6, 7) for closing shutter (5) and the housing (1) has guiding members (9) interacting with the actuating elements (6,7) in such a way that the movement of the movable shutter is linked to the movement of the access trap (2).

20 Claims, 6 Drawing Sheets

MONEY HANDLING UNIT PROVIDED WITH A REMOVABLE COIN RECEPTACLE

The present invention relates to a method of secure collection by exchange of receptacle in machines having a removable coin storage receptacle.

There are numerous machines equipped with a removable or fixed coin receptacle (cash box or hopper) for storage of coins introduced by users. Examples include public telephones, product dispensers, ticket dispensers, car parking machines such as parking meters, etc.

It will also be understood that when these machines are installed in public places, they are particularly vulnerable to acts of vandalism. Special precautions must therefore be taken to protect the contents of the coin storage receptacle.

Furthermore, specific protection measures must be taken to ensure the security of money collection operations by operators, and more precisely to prevent attempted fraud by operators when performing these operations. Specific protection measures of this type will be examined in greater detail below.

The operations involved in collecting money depend on the type of machine, or more exactly on the type of receptacle used:

- In the case of a fixed coin receptacle, it is necessary to transfer all the coins contained in the receptacle to a specific item of collection equipment;
- In the case of a removable coin receptacle, commonly called a removable cash box, the collection operation is carried out by exchanging the receptacle. The collection operator replaces the receptacle containing the money with an empty receptacle. Access to the removable cash box is possible by means of a collection trap fitted on the machine.

It will easily be understood that the second case presents many more advantages in terms of security at collection, since the operator does not have to handle the coins directly.

Nevertheless, by construction, removable cash boxes comprise an orifice by which the coins introduced by the user enter the cash box.

In order to prevent collection operators from being tempted to extract coins via this orifice after extraction of the removable cash box, a known method is to equip these removable cash boxes with a closing shutter which must close the orifice during collection operations in such a way that the operator can not at any time be in direct contact with the money.

In the existing solutions, the orifice is closed by the mobile shutter as follows:

- either by a specific operation performed by the collection agent before withdrawal of the removable cash box from the machine,
- or automatically as the collection agent withdraws the removable cash box from the machine.

In both cases, there is an indefinite period of time between the opening of the trap giving access to the removable cash box and the actual withdrawal of the cash box, during which period the orifice is not closed by the closing shutter. So in the existing solutions, there is always a risk of fraud by operators during the collection operation.

The object of the present invention is to alleviate the above disadvantages by proposing a money handling unit of a type comprising a removable coin receptacle enabling secure collection of the coins contained in the receptacle.

More precisely, the present invention relates to a money handling unit provided with a removable coin receptacle of a type comprising a fixed structure comprising a housing and a removable coin receptacle comprising an orifice for insertion of coins and a closing shutter movable between an open position in which the orifice is accessible and a closing position in which the orifice is closed, the receptacle comprising actuating means for the closing shutter and the housing comprising guiding means intended to interact with the actuating means, characterised in that said fixed structure also comprises a trap for access to the interior of the housing movable between an open position and a closed position, said receptacle being intended to be inserted in the trap forming the reception structure, and in that said guiding means interact with said actuating means when the trap moves from its closed position to its open position, in order to cause simultaneously the movement of the shutter from its open position to its closed position.

Advantageously, said guiding means also interact with said actuating means when the trap moves from its open position to its closed position, to cause simultaneously the movement of the shutter from its closed position to its open position.

The present invention therefore provides a level of security of collected money greater than that of existing devices by linking the closing action of the coin insertion orifice of the receptacle to the closing action of the collection trap and vice versa.

In a preferred embodiment of the invention, said actuating means comprise a pin integral in translation with the closing shutter, the pin being movable translationally along a guide slot, and the guiding means of the housing comprise a groove receiving and guiding said pin when the trap moves, causing simultaneously the movement of the pin translationally along the guide slot.

In a first possible embodiment, the receptacle comprises what is known as a "one-off" mechanism for opening/closing the closing shutter called "one-off", this mechanism permitting only a single opening/closing cycle of the closing shutter performed on the same receptacle and linked to the movement of the trap.

According to a second possible embodiment, the receptacle comprises what is known as a "one-off" insertion/withdrawal system, this system permitting only a single insertion/withdrawal cycle of the receptacle into or from the trap performed on the same receptacle.

Advantageously, the "one-off" insertion/withdrawal system is manually set, before use of the receptacle, by action on a setting shaft within the receptacle.

In this second embodiment, the closing shutter of the receptacle preferably comprises a shaft extending longitudinally in the plane of the shutter and integral with the translational movement of the closing shutter, and the receptacle comprises, on a lateral wall diagonal to the direction of translation of the closing shutter, a lateral orifice intended to permit passage of a free end of the shaft when the closing shutter is moved translationally to its open position.

The receptacle also preferably comprises a locking bolt intended to prevent opening of the closing shutter when the receptacle has been withdrawn from the trap.

Advantageously, the receptacle also comprises:

- a rod, movable in translation along a lateral wall and intended firstly to trigger said "one-off" insertion/withdrawal system and, secondly, to actuate said locking bolt to release the closing shutter;
- a lower orifice opposite an end of the rod;

and the trap comprises at its bottom, on a lower wall, a release pin intended to penetrate said lower orifice when the receptacle is placed in the trap and to cause translational movement of said rod.

The trap forming the reception structure may also comprise a shutter latch preventing opening of the closing shutter while the trap is in the open position or not yet sufficiently closed.

In this case, the shutter latch preferably consists of a plate intended to extend parallel to the lateral wall of the receptacle carrying the lateral orifice, said plate being capable of being moved translationally by movement of the trap, and comprising an opening intended to allow free passage or block passage of the shaft.

Whatever the embodiment, the money handling unit may also comprise a lock system for locking/unlocking the access trap in its closed position.

The invention will be better understood from the following description of two non-limiting exemplary of embodiments given with reference to the appended drawings, in which.

Figure 7A:
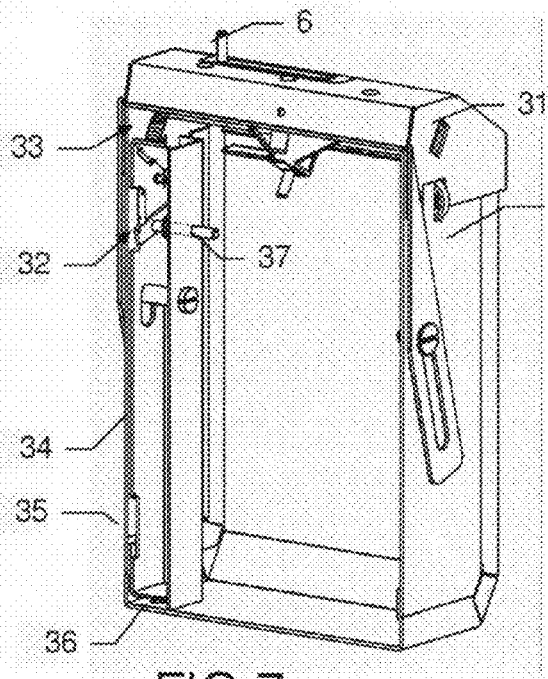
Figure 7B:
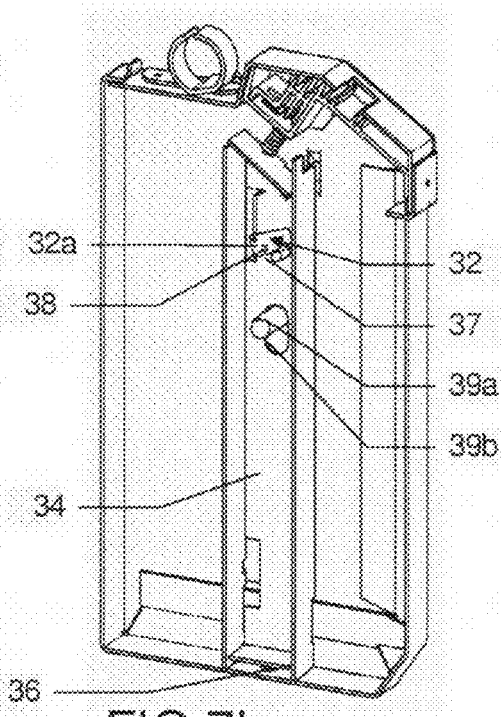
Figure 8A:
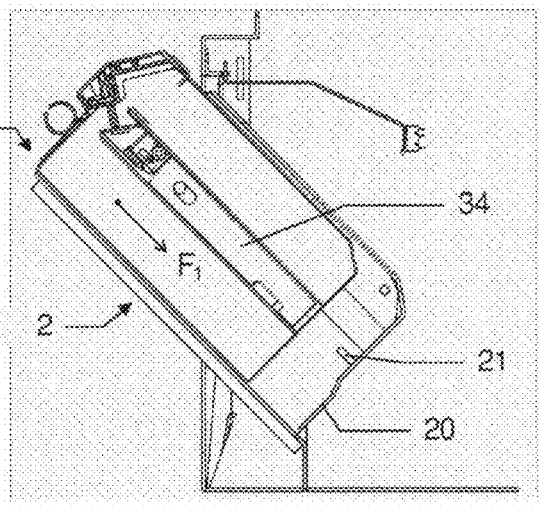
Figure 8B:
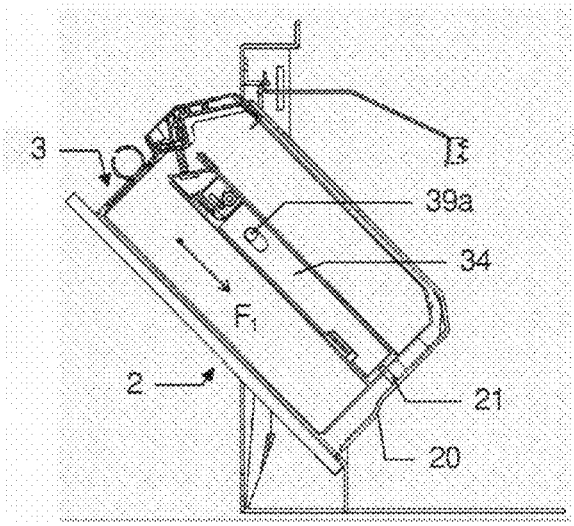
Figure 8C:
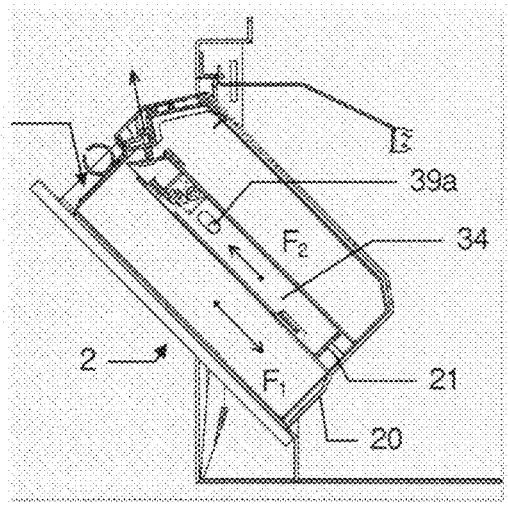
Figure 9A:
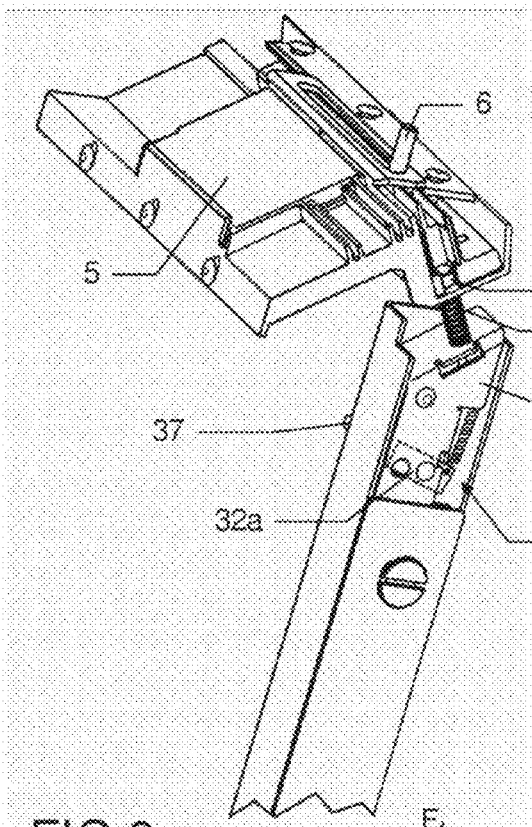
Figure 9B:
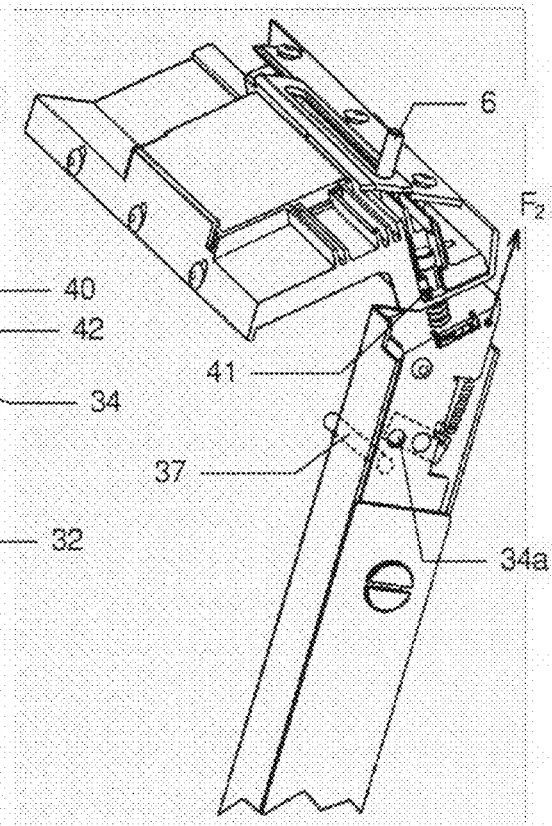
Figure 9C:
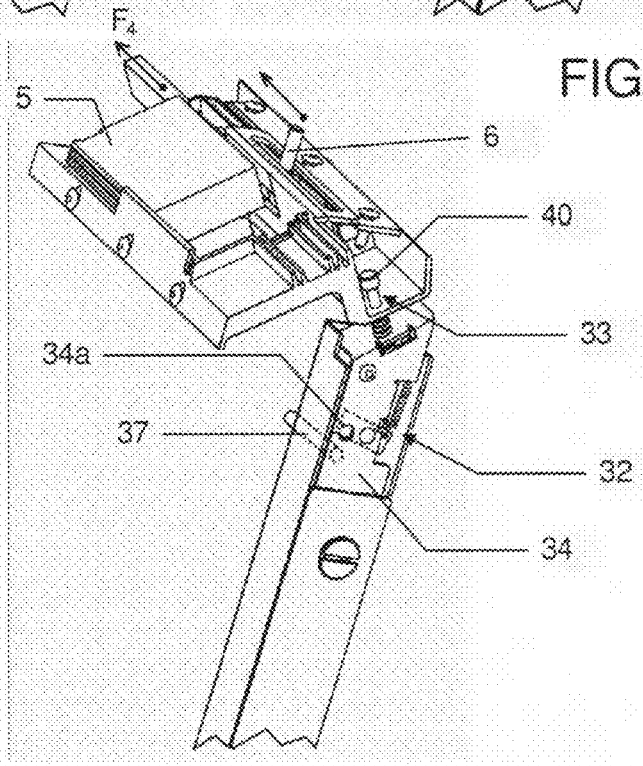
Figure 10:
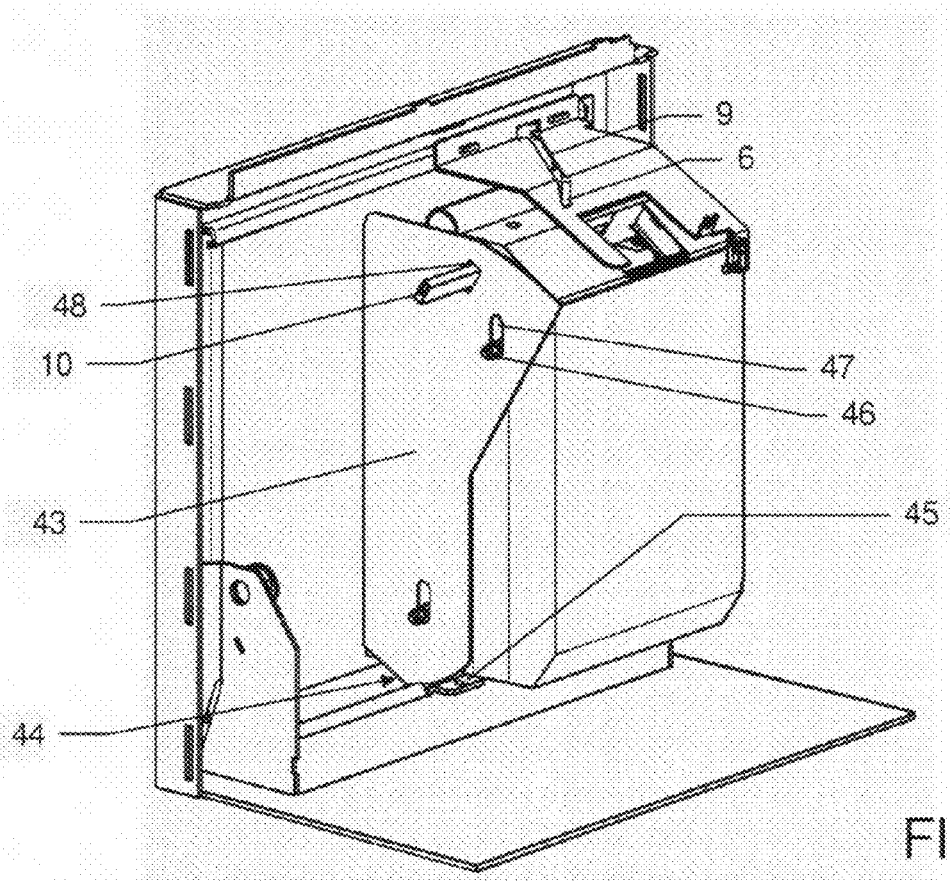
Figure 11:
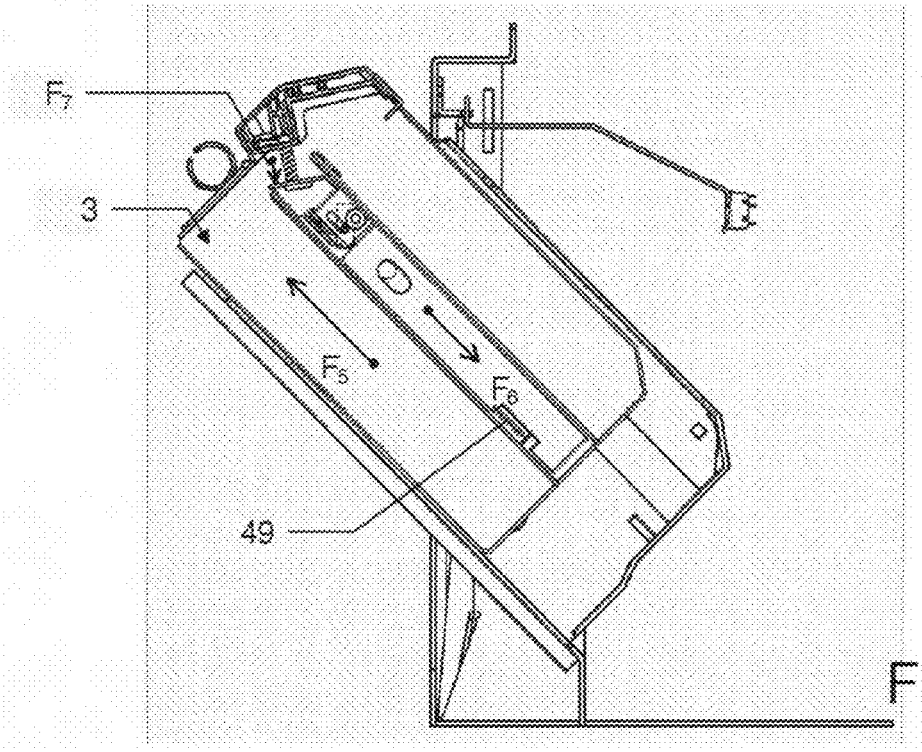

FIGS. 7*a* and 7*b* are partial views of the interior of the receptacle according to the second embodiment;

FIGS. 8*a* to 8*c* illustrate schematically the placing of the receptacle in the unit according to the second embodiment;

FIGS. 9*a* to 9*c* illustrate schematically the operations to unlock the closing shutter for the receptacle according to the second embodiment;

FIG. 10 illustrates schematically the relative positioning of the various elements once the receptacle according to the second embodiment has been placed in the unit and the trap forming the reception structure has been reclosed;

FIG. 11 illustrates schematically the operation for withdrawal of the receptacle according to the second embodiment.

The money handling unit according to the first embodiment illustrated in FIGS. 1 to 4 comprises:

- firstly, a fixed structure comprising a housing 1 and an access trap 2 forming a reception structure for a coin receptacle;
- secondly, a removable coin receptacle 3 intended to be inserted into or withdrawn from the housing 1 during operations to collect money.

The access trap 2 inside the housing is movable, here by pivoting, between an open position in which a receptacle may be extracted or inserted, and a closed position in which no-one has access to the interior of the housing 1.

The coin receptacle 3 comprises an orifice 4 (see FIGS. 3 and 4) to enable insertion of coins by a user of the unit, together with a closing shutter 5 movable between a first position, known as the closed position, in which the closing shutter prevents access to the orifice 4, and a second position, known as the open position, in which the orifice 4 is accessible.

Figure 1:
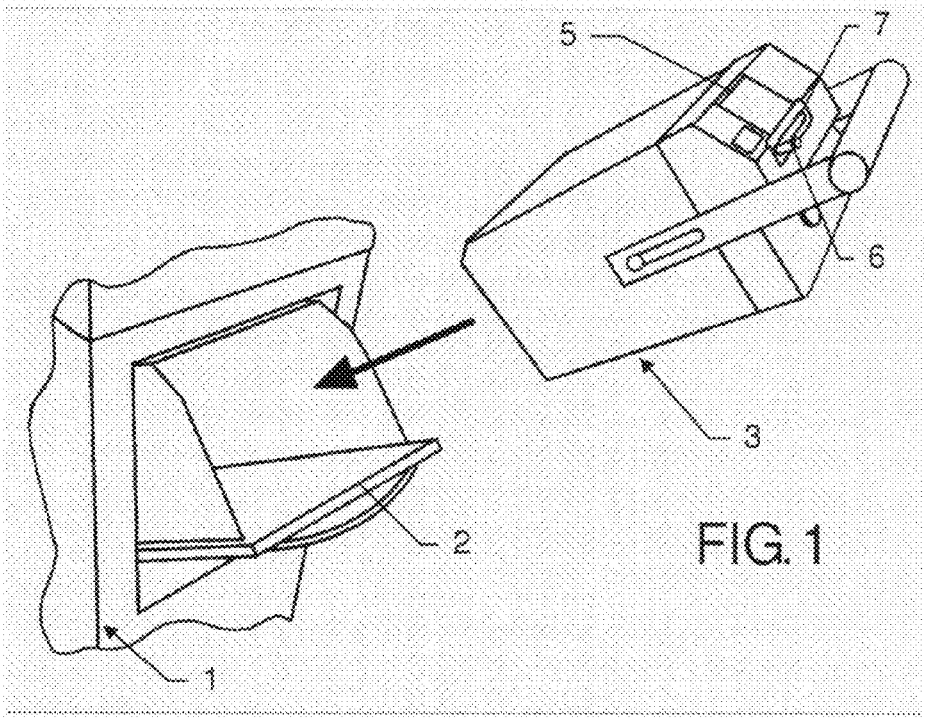
FIG. 1 illustrates a money handling unit according to a first possible embodiment of the present invention before insertion of a removable receptacle.
Figure 2:
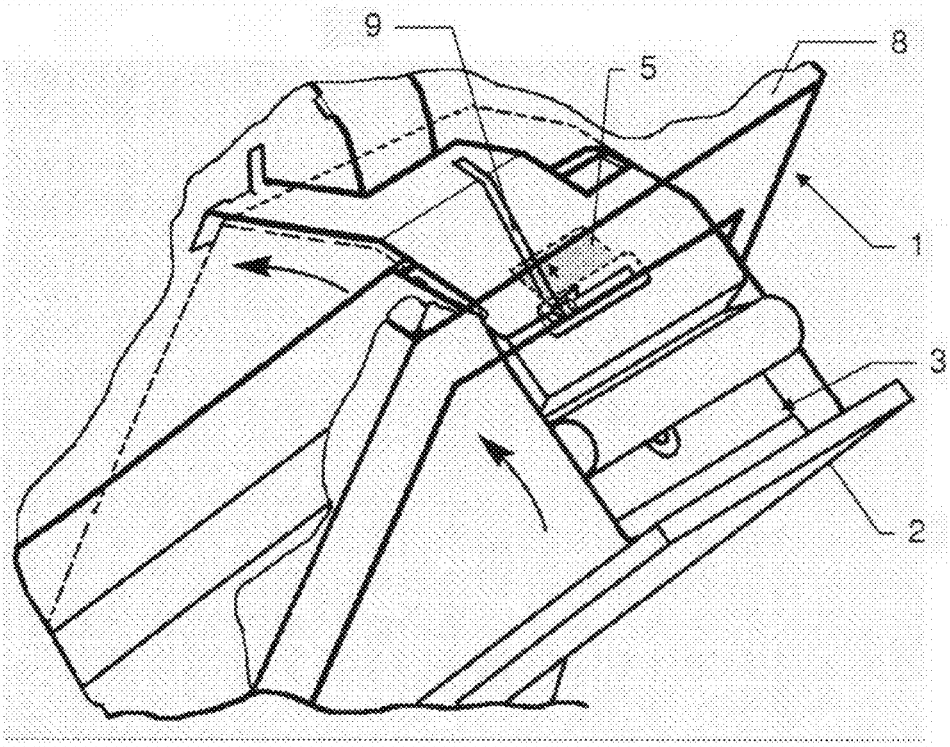
FIG. 2 shows the interaction of the elements of the money handling unit in FIG. 1 when the removable receptacle is inserted.

As can be seen from FIGS. 1 to 4, the closing shutter 5 must perform its function to close the orifice 4 as soon as the receptacle is outside the housing 1 (as shown in FIG. 1) or when the access trap 2 is in a position such that the orifice 4 is accessible from the outside (as shown in FIG. 2).

In the example represented, the closing shutter 5 is a plate mounted so that it is movable in translation in a plane parallel to or combined with the plane of the opening 4, the translational movement between the two positions of opening or closing referred to being obtained by movement of an actuating means of the closing shutter, here comprising a pin 6 integral in translation with the closing shutter 5. The translation movement of the pin 6 is limited by the length of a guide slot 7 for the pin 6. The length of the slot is determined so that, when the pin rests against the ends of this guide slot, the closing shutter 5 is in one or the other of the two positions of opening or closing previously defined.

The housing 1 comprises, on its upper internal wall 8, guiding means consisting here of a groove 9, these guiding means being intended to interact with the actuating means 6 of the closing shutter when the receptacle 3 is inside the housing 1. More precisely, the shape, size and inclined arrangement of the groove 9 are suitable to receive the actuating means 6 of the removable receptacle 3 when the trap 2 is closed, and to drive the pin 6, when it moves along the groove 9, in a translational movement along the guide slot 7, simultaneously causing the translational movement of the closing shutter 5. The characteristics of the groove 9 are preferably adapted so that the opening, even partial, of the orifice 4 can only begin when this orifice is no longer accessible from the outside, even if the trap is still partially open.

Advantageously, the money handling unit is also equipped with a lock system, not represented, (mechanical key, identification badge, biometry, electronic key, etc.) to lock/unlock the access trap 2 in its closed position.

Figure 4:
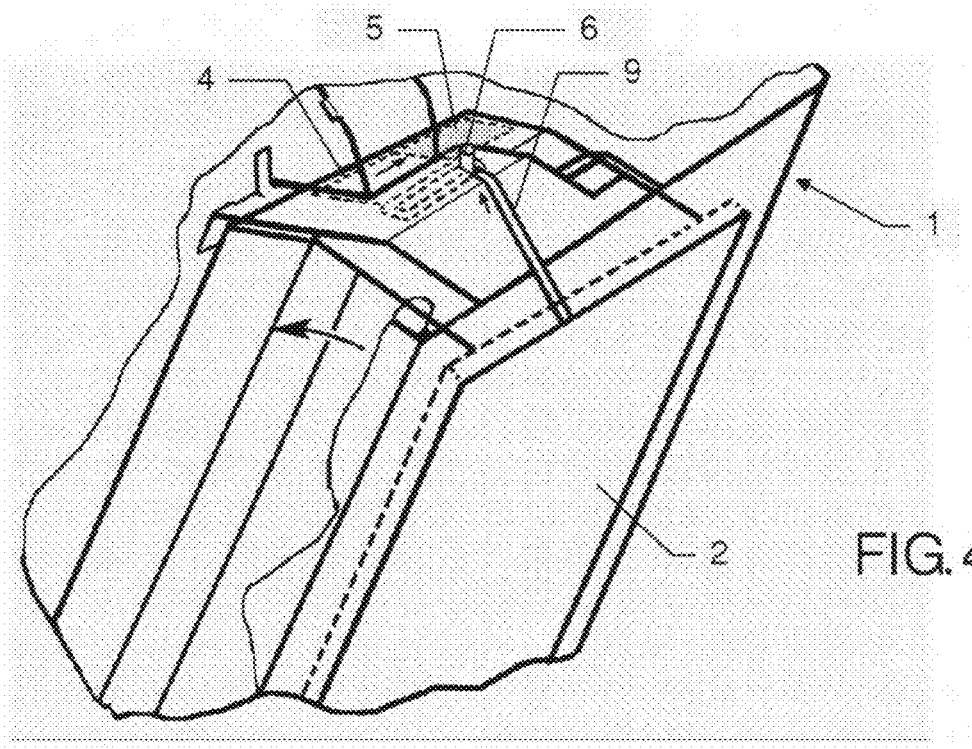
FIG. 4 shows the interaction of the elements of the money handling unit in FIG. 1 after insertion of the receptacle and closure of the access trap.

In the exemplary embodiment proposed according to the first embodiment, the sequence of collection operations for the removable receptacle is broken down as follows, the money handling unit being in the state represented in FIG. 4 (access trap closed, closing shutter 5 in the open position):

- The collection agent identifies himself using a logical or mechanical identifier;
- The unit permits, or does not permit, access to the trap 2, according to the identification presented by the agent;
- If access is permitted, the trap is unlocked, the collection agent can open the access trap and proceed to exchange the receptacle for an empty receptacle.

Figure 3:
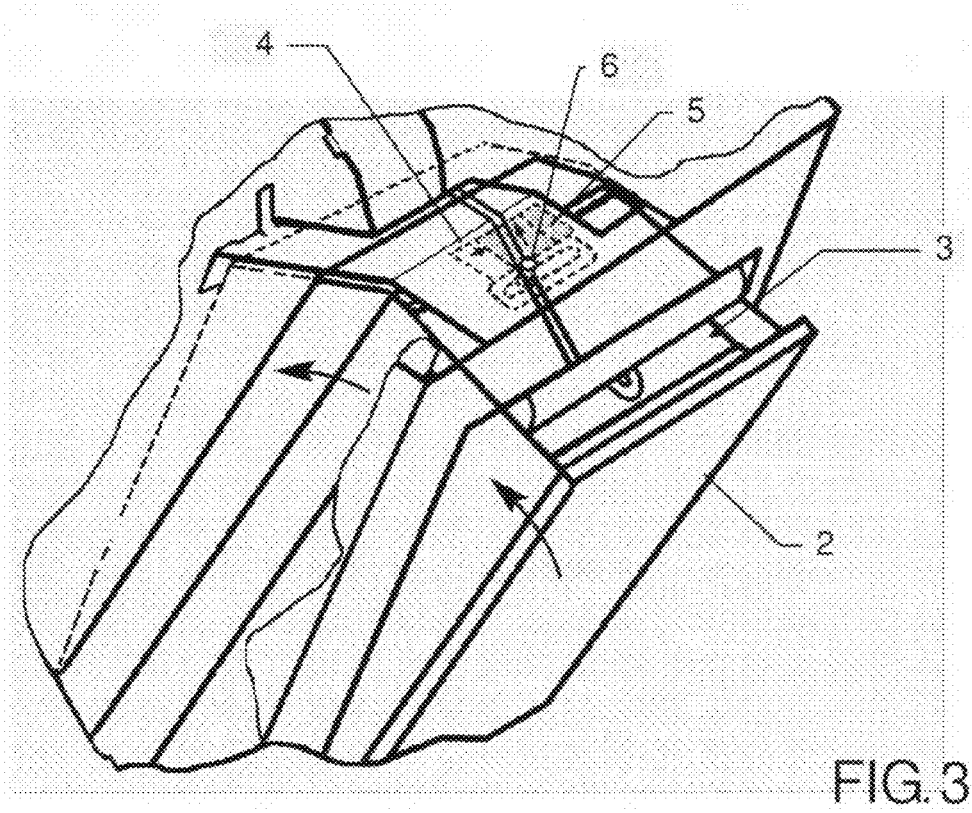
FIG. 3 shows the interaction of the elements of the money handling unit in FIG. 1 in an intermediate position of the access trap.

The sequence of operations for extraction of the receptacle itself is broken down as follows:

- The collection agent pivots the access trap 2 around its axis of rotation;
- During this opening movement of the trap, the pin 6 is guided into the groove 9 and moves translationally in the guide slot 7, simultaneously causing movement of the closing shutter from its open position to its closed position. FIG. 3 illustrates an intermediate position of the access trap 2 in which the closing shutter can be seen partially open;
- The trap 2 continues to pivot on its axis of rotation until the pin 6 comes out of the groove 9. As the trap 2 is stable in the open position, the closing shutter 5 is completely closed.

It is then possible to exchange a full receptacle for a new empty receptacle quite safely since the orifice 4 of the full receptacle is completely closed.

The sequence of operations for introducing a new empty receptacle is broken down into the following successive stages, the initial state of the unit being that shown in FIG. 1:

- The access trap 2 is stable in the open position and forms an angle of around 45° in relation to the vertical;

The new removable, empty receptacle 3 is introduced into the access trap, while the closing shutter 5 is in the closed position;

The collection agent pivots the access trap 2 around its axis of rotation;

During this closing movement of the trap, the pin 6 engages in the groove 9 and is then guided in this groove in a translational movement simultaneously causing the translational movement of the closing shutter (see FIG. 2);

When the trap has reached its closed position (FIG. 4), the closing shutter 5 is completely open, opposite an opening, not represented, in the housing, so as to allow a user to introduce coins via the orifice 4;

The unit locks the access trap 2.

So, by means of the invention, the action of closing/opening the access trap 2 simultaneously controls the opening/closing of the closing shutter, thus allowing a collection operator to recover in a single action a secured receptacle (orifice closed). The invention therefore, in addition to providing security against problems of fraud during collection operations, makes it possible to simplify the ergonomics and to increase the rapidity of collection operations.

In order to increase the security of the assembly, the receptacle is advantageously equipped with a "one-off" opening/closing mechanism, this mechanism permitting only a single opening/closing cycle of the closing shutter 5 performed on the same receptacle. Such a mechanism is not represented here, but is for example described in patent application EP-A 0 320 335. This mechanism consists of mechanical means located inside the receptacle, accessible only by a person authorised to open the receptacle.

Associated with the unit according to the invention, such a mechanism will therefore permit only a single closing and a single opening of the access trap receiving the same receptacle. It is therefore impossible, after extraction of a full receptacle, for an unauthorised person to actuate again the actuating means 6. Only an authorised person can reset the mechanism so as to enable the receptacle to be used again.

In certain circumstances, it may be beneficial not to allow the collection agent to withdraw the removable coin receptacle, even when he has opened the trap. This may be found to be necessary, for example, when the trap forming the reception structure receives, in addition to the removable coin receptacle, a removable ticket receptacle, and only the ticket receptacle is to be withdrawn when the collection agent visits. In order to enable the collection agent to reclose the trap without withdrawing the coin receptacle, it is necessary to provide a "one-off" system which will act not with regard to opening/closing of the closing shutter 5, as in the first embodiment described above, but with regard to the insertion/withdrawal of the receptacle into or from the trap, so that it permits only a single insertion followed by a single withdrawal of the same receptacle. A second embodiment according to the present invention will now be described with reference to FIGS. 5 to 11, which show the modifications made, firstly, to the coin receptacle, and secondly, to the unit, in order to retain the option of linking the movement of the closing shutter 5 to the movement of the trap, while causing the "one-off" system to perform the action of insertion/withdrawal of the coin receptacle.

Figure 5:
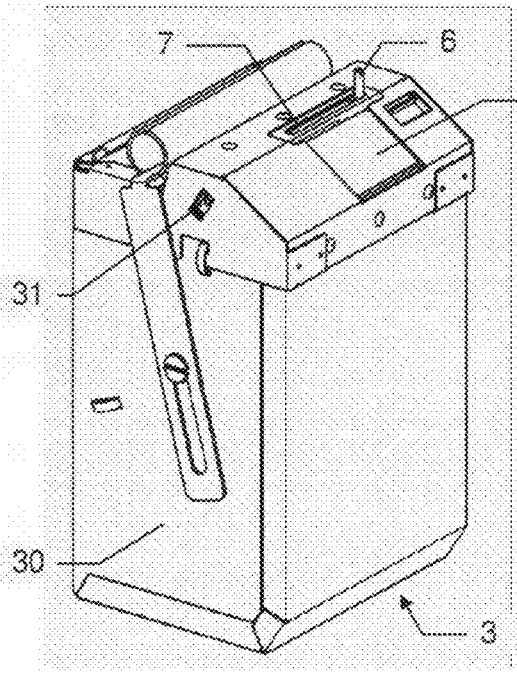
FIGS. 5 and 6 show a money handling unit according to a second possible embodiment, with a closing shutter in, respectively, closed position and partially open position.
Figure 6:
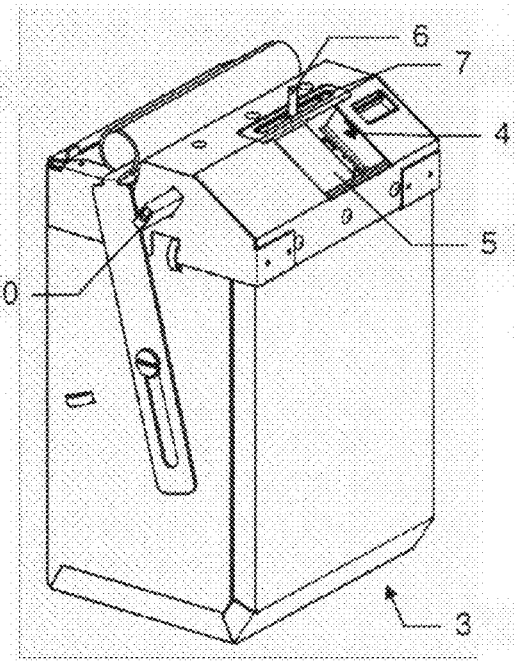

As can be seen in FIGS. 5 and 6, the removable coin receptacle 3 is equipped with an orifice 4 for coin insertion, the closing shutter 5, and the pin 6 forming actuating means of the shutter, movable in translation along a guide slot 7, previously described in relation to the first embodiment.

Alternatively, the closing shutter 5 also comprises a shaft 10 extending longitudinally in the plane of the closing shutter 5, integral with the translational movement of the shutter. When the closing shutter 5 is in its closed position (FIG. 5), the shaft 10 is entirely housed inside the receptacle 3. The receptacle 3 also offers, in one of its lateral walls 30 diagonal to the direction of translation of the closing shutter 5, a lateral orifice 31 permitting passage of the free end of the shaft 10 to the exterior of the receptacle 3 when the closing shutter 5 is moved translationally to its opening position (FIG. 6).

The removable receptacle 3 also comprises, in this second embodiment, as shown in FIGS. 7*a* and 7*b*:

a "one-off" system for insertion/withdrawal 32, intended to permit only a single insertion/withdrawal cycle of the receptacle into or from the trap;

a locking bolt 33, intended to prevent opening of the closing shutter 5 when the receptacle 3 has been withdrawn from the trap;

a rod 34 movable translationally along a lateral wall of the receptacle (here, the lateral wall 35 opposite the lateral wall 30 carrying the orifice 31 for passage of the shaft 10), this rod 34 being intended particularly to trigger the "one-off" system 32 and to actuate the locking bolt 33, as will be explained below;

a lower orifice 36 in relation to an end of the rod 34.

As shown in FIGS. 8*a* to 8*c*, the trap 2 forming the reception structure comprises at its bottom on its lower wall 20 a release pin 21 intended to penetrate the lower orifice 36 of the receptacle when the receptacle 3 is placed in the trap 2, in to the direction indicated by the arrow $F_1$ (FIGS. 8*a* and 8*c*). This release pin 21 must cause translational movement of the rod 34 in the direction indicated by arrow $F_2$ visible in FIG. 8*c*. This translation of the rod 34 must cause, firstly, triggering of the "one-off" insertion/withdrawal system 32 and, secondly, actuation of the locking bolt 33 to trigger the movement of the closing shutter 5.

More precisely, before use of an empty coin receptacle 3, the "one-off" insertion/withdrawal system 32 is set manually by action on a setting shaft 37 inside the receptacle (see FIGS. 7*a* and 7*b*). This setting operation is performed by an authorised person distinct from the actual collection operators. The "one-off" insertion/withdrawal system 32 is in the form of a part 32*a* pivoting around an axis 38. Once set, the "one-off" insertion/withdrawal system is in the position indicated in FIGS. 7*b*, 8*a* and 9*a*, a position in which the setting shaft 37 rests against the part 32*a*. The movement of the rod 34 in the direction of the arrow $F_2$ (FIG. 8*c* or FIG. 9*b*) must then trigger (i.e. render operational) the "one-off" insertion/withdrawal system 32. This movement of the rod is limited in translation by a stop pin 39*a* extending transversally in relation to the rod 34 resting against the end of an opening 39*b* oblong in shape in the rod 34 (see FIG. 8*c*). Furthermore, in the operational position of the "one-off" system, the setting shaft rests against the rod 34 (see FIG. 9*b*).

After withdrawal of the receptacle by a collection agent, the receptacle can not be replaced without first being emptied of these coins by an authorised person, who may then reset the system so that the receptacle can be used again. An orifice 34*a* (marked on FIGS. 9*a*, 9*b* and 9*c*) is provided on the rod 34, this orifice moving to opposite the setting shaft 37 when the rod 34 is moved translationally in the opposite direction to arrow $F_2$ at the moment of withdrawal of the receptacle. The setting shaft 37 penetrates this orifice so that it is no longer possible to trigger the system again without first resetting the system. This resetting consists in pulling manually on the setting shaft 37 to pull it out of the orifice 34*a*.

The action of the rod 34 on the locking bolt 33 is made clearer by FIGS. 9*a* to 9*c*. The locking bolt 33 is in the form of a longitudinal shaft, one end of which is resting on the rod 34, the other free end offering a head 40 of diameter greater than the shaft 33. When the shutter 5 is in the locked position (FIG. 9*a*), the head 40 is engaged in a groove 41 integral with the shutter and having a width less than the diameter of the head 40, preventing any release of the head from the groove. The locking bolt is held in this rest position by a return spring 42. When the shaft 34 moves translationally (arrow $F_2$ in FIG. 9*b*), the longitudinal shaft 33 is also moved so that the head 40 comes out of the groove 41. The closing shutter can therefore be released from the locking bolt 33 and becomes free to be moved to the open position (arrow $F_4$ in FIG. 9*c*).

The movement of the closing shutter 5 to its open position is carried out according to the principle of the invention, as for the first embodiment, by closure of the trap 2 by interaction of the pin 6 with a guide groove 9 in the housing (see FIG. 10).

As has already been described, it is the total insertion of the receptacle into the trap forming the reception structure which makes it possible to release the closing shutter 5.

In order to prevent the closing shutter 5 from being opened when the trap 2 is still in the open position, or is not sufficiently closed, and also to prevent a collection agent from stealing coins contained in the coin receptacle, the trap 2 forming the reception structure also comprises a shutter latch which takes over the function of the locking bolt 33 when the receptacle is in place in the trap 2.

In the embodiment represented in FIG. 10, this shutter latch consists of a plate 43 intended to extend parallel to the lateral wall 30 of the receptacle when the latter is in place. The plate 43 comprises a cam profile 44 in its lower part interacting with a part 45 fixed to the housing 1 to enable translational movement of the plate 43, limited by stop pins 46 resting against an end of oblong openings 47 provided in the plate 43. The plate 43 also comprises an opening 48 intended to allow free passage of the shaft 10 of the receptacle. The movement of the plate 43 is controlled by the movement of the trap. More precisely, the action of closing the trap results in movement of the plate so as to place the opening 48 opposite the shaft 10 and to enable translation of the latter when the pin 6 moves along the groove 9. FIG. 10 illustrates the relative positioning of the various components when the trap has been completely closed. In this case, it can be seen that the closing shutter of the receptacle is completely open, thus enabling reception of coins.

Conversely, the action of opening the pivoting trap should first control the beginning of closure of the closing shutter 5, at least until the shaft 10 is no longer crossing the opening 48, then the movement of the plate 43 so that the opening 48 is no longer opposite the opening 48, it being possible to make this movement simultaneously with the end of movement of the closing shutter to its closing position. So when the trap has been completely opened, but the receptacle has not yet been withdrawn, it is not possible to open the closing shutter 5.

Once the receptacle has been withdrawn, it is the locking bolt which takes over the function of preventing opening of the closing shutter. As FIG. 11 shows, the movement of withdrawal of the receptacle in the direction indicated by arrow $F_5$ permits, by means of a return spring 49, movement of the rod 34 in the direction indicated by arrow $F_6$, and this again places the locking bolt in its position of locking the shutter (arrow $F_7$). Furthermore, as has been explained previously, movement of the rod 34 in the direction indicated by arrow $F_6$ should also cause locking of the "one-off" system 32, which must be reset manually if it is required to re-use the receptacle.

The exemplary of embodiment illustrated in the drawings shows the use of a pivoting access trap 2. Of course, other embodiments may be envisaged without departing from the scope of the invention. In particular, the trap may be designed as not pivoting, but movable in a translational movement, the shape, size and arrangement of the groove 9 then being adapted as a result. Furthermore, the location of the guiding means 9 in the upper wall of the housing 1 is imposed here by the structure of the receptacle. Of course, other locations may be envisaged.

The invention claimed is:

1. A money handling unit with a removable coin receptacle, comprising:

a housing (1) and a removable coin receptacle (3) comprising:

an orifice (4) to insert coins, and a closing shutter (5) movable between an open position in which the orifice (4) is accessible and a closed position in which the orifice (4) is closed, the receptacle comprising actuating means (6, 7) of the closing shutter (5) and the housing (1) comprising guiding means (9) interacting with the actuating means (6, 7); and a fixed structure comprising:

a trap (2) providing access to the inside of the housing movable between an open position and a closed position, said receptacle being inserted in the trap (2) forming a reception structure with the receptacle, so as to carry along the receptacle when moving between the open position and the closed position, and in that said guiding means (9) interact with said actuating means (6, 7) when the trap (2) moves from its closed position to its open position, to cause simultaneously the movement of the closing shutter (5) from its open position to its closed position.

2. The money handling unit according to claim 1, wherein said guiding means (9) also interact with said actuating means (6, 7) when the trap moves from its open position to its closed position, to cause simultaneously the movement of the closing shutter from its closed position to its open position.

3. The money handling unit according to claim 1, wherein said actuating means (6, 7) comprise a pin (6) integral in translation with the closing shutter (5), the pin (6) being mobile in translation along a guide slot (7), and in that the guiding means of the housing comprise a groove (9) receiving and guiding said pin (6) when the trap moves, simultaneously causing movement of the pin translationally along the guide slot (7).

4. The money handling unit according to claim 3, wherein the length of the guide slot (7) is determined so that, when the pin rests against the ends of this guide slot, the closing shutter (5) is in one or the other of the two positions of opening or closing.

5. The money handling unit according to claim 1, wherein the receptacle (3) comprises a one-off mechanism to open and close the closing shutter, this mechanism permitting only a single opening and closing cycle of the closing shutter (5) performed on the same receptacle and linked to the movement of the trap.

6. The money handling unit according to claim 3, wherein the receptacle (3) comprises what is known as a one-off insertion/withdrawal system (32), this system permitting only a single cycle of insertion/withdrawal of the receptacle into or from the trap performed on the same receptacle.

7. The money handling unit according to claim 6, wherein the "one-off" insertion/withdrawal system (32) is set manually, before use of the receptacle, by action on a setting shaft (37) inside the receptacle.

8. The money handling unit according to claim 6, wherein the closing shutter (5) of the receptacle (3) comprises a shaft (10) extending longitudinally in the plane of the shutter and integral with the translational movement of the closing shutter (5), and in that the receptacle (3) comprises, on a lateral wall (30), perpendicular to the direction of translation of the closing shutter (5), a lateral orifice (31) permitting passage of a free end of the shaft (10) when the closing shutter (5) is moved translationally to its open position.

9. The money handling unit according to claim 6, wherein the receptacle (3) also comprises a locking bolt (33) to prevent opening of the closing shutter (5) when the receptacle (3) has been withdrawn from the trap (2).

10. The money handling unit according to claim 9, wherein the receptacle (3) also comprises:

a rod (34) movable translationally along a lateral wall (35) to trigger said one-off insertion/withdrawal system (32) and secondly, to actuate said locking bolt (33) to release the closing shutter (5);

a lower orifice (36) opposite an end of the rod (34); and in that the trap (2) comprises at its bottom, on a lower wall (20), a release pin (21) to penetrate said lower orifice (36) when the receptacle is placed in the trap and to cause the translational movement of said rod (34).

11. The money handling unit according to claim 10, wherein the trap (2) forming a reception structure also comprises a shutter latch (43) preventing the opening of the closing shutter (5) while the trap (2) is in open position or not yet sufficiently closed.

12. The money handling unit according to claim 11, wherein the shutter latch consists of a plate (43) to extend parallel to the lateral wall (30) of the receptacle carrying the lateral orifice (31), said plate (43) being capable of being moved translationally by the movement of the trap, and comprising an opening (48) to permit free passage or block the passage of the shaft (10).

13. The money handling unit according to claim 1, wherein it also comprises a lock system to lock/unlock the access trap in its closed position.

14. The money handling unit according to claim 2, wherein said actuating means (6, 7) comprise a pin (6) integral in translation with the closing shutter (5), the pin (6) being mobile in translation along a guide slot (7), and in that the guiding means of the housing comprise a groove (9) receiving and guiding said pin (6) when the trap moves, simultaneously causing movement of the pin translationally along the guide slot (7).

15. The money handling unit according to claim 4, wherein the receptacle (3) comprises what is known as a one-off insertion/withdrawal system (32), this system permitting only a single cycle of insertion/withdrawal of the receptacle into or from the trap performed on the same receptacle.

16. The money handling unit according to claim 7, wherein the closing shutter (5) of the receptacle (3) comprises a shaft (10) extending longitudinally in the plane of the shutter and integral with the translational movement of the closing shutter (5), and in that the receptacle (3) comprises, on a lateral wall (30), perpendicular to the direction of translation of the closing shutter (5), a lateral orifice (31) to permit passage of a free end of the shaft (10) when the closing shutter (5) is moved translationally to its open position.

17. The money handling unit according to claim 14, wherein the length of the guide slot (7) is determined so that, when the pin rests against the ends of this guide slot, the closing shutter (5) is in one or the other of the two positions of opening or closing.

18. The money handling unit according to claim 15, wherein the "one-off" insertion/withdrawal system (32) is set manually, before use of the receptacle, by action on a setting shaft (37) inside the receptacle.

19. The money handling unit according to claim 7, wherein the receptacle (3) also comprises a locking bolt (33) to prevent opening of the closing shutter (5) when the receptacle (3) has been withdrawn from the trap (2).

20. The money handling unit according to claim 8, wherein the receptacle (3) also comprises a locking bolt (33) to prevent opening of the closing shutter (5) when the receptacle (3) has been withdrawn from the trap (2).

* * * * *